US006923011B2

(12) United States Patent
Manole

(10) Patent No.: US 6,923,011 B2
(45) Date of Patent: Aug. 2, 2005

(54) MULTI-STAGE VAPOR COMPRESSION SYSTEM WITH INTERMEDIATE PRESSURE VESSEL

(75) Inventor: Dan M. Manole, Tecumseh, MI (US)

(73) Assignee: Tecumseh Products Company, Tecumseh, MI (US)

( * ) Notice: Subject to any disclaimer, the term of this patent is extended or adjusted under 35 U.S.C. 154(b) by 26 days.

(21) Appl. No.: 10/653,581

(22) Filed: Sep. 2, 2003

(65) Prior Publication Data

US 2005/0044865 A1 Mar. 3, 2005

(51) Int. Cl.[7] ..... F25B 45/00; F25B 1/00
(52) U.S. Cl. ..... 62/149; 62/498; 62/115
(58) Field of Search ..... 62/149, 498, 510, 62/503, 509, 174, 115, 119

(56) References Cited

U.S. PATENT DOCUMENTS

| | | | | |
|---|---|---|---|---|
| 933,682 | A | 9/1909 | Vorhees | |
| 1,408,453 | A | 3/1922 | Goosmann | |
| 1,591,302 | A | 7/1926 | Franklin | |
| 1,867,748 | A | 7/1932 | MacCabee | |
| 1,976,079 | A | 10/1934 | Mallinckrodt | |
| 2,133,960 | A | 10/1938 | McCloy | 62/115 |
| 2,219,815 | A | 10/1940 | Jones | 257/9 |
| 2,482,171 | A | 9/1949 | Gygax | 62/127 |
| 2,617,265 | A | 11/1952 | Ruff | 62/3 |
| 2,778,607 | A | 1/1957 | Leoni | 257/24 |
| 2,901,894 | A | 9/1959 | Zearfoss, Jr. | 62/509 |
| 3,022,642 | A | 2/1962 | Long | 62/196 |
| 3,234,738 | A | 2/1966 | Cook | 60/59 |
| 3,365,905 | A | 1/1968 | Barbier | 62/196 |
| 3,400,555 | A | 9/1968 | Granryd | 62/498 |
| 3,413,815 | A | 12/1968 | Granryd | 62/6 |
| 3,423,954 | A | 1/1969 | Hamish et al. | |
| 3,513,663 | A | 5/1970 | Martin, Jr. et al. | 62/159 |
| 3,597,183 | A | 8/1971 | Murphy et al. | 62/114 |
| 3,638,446 | A | 2/1972 | Palmer | 62/202 |

(Continued)

FOREIGN PATENT DOCUMENTS

DE 278095 6/1912

(Continued)

OTHER PUBLICATIONS

U.S. Patent Application—Dan M. Manole, et al., Apparatus for the Storage and Controlled Delivery of Fluids, filed Sep. 2, 2003.

(Continued)

*Primary Examiner*—Chen Wen Jiang
(74) *Attorney, Agent, or Firm*—Baker & Daniels

(57) ABSTRACT

A vapor compression system includes a first compression mechanism that compresses the working fluid from a low suction pressure to an intermediate pressure, a second compression mechanism that compresses intermediate pressure working fluid to a higher discharge pressure, and a fluid circuit circulating the working fluid discharged from the second compression mechanism to the first compression mechanism. The fluid circuit includes, in serial order, a first high pressure heat exchanger, an expansion device and an evaporator. The system may be operated as a transcritical system employing carbon dioxide as the working fluid. An intermediate pressure vessel is in communication with the system between the first and second compression mechanisms and working fluid at an intermediate pressure is communicated with the vessel. The system may be regulated by controlling the mass of working fluid contained in the intermediate pressure vessel, e.g., by regulating the temperature or storage volume of the vessel.

31 Claims, 3 Drawing Sheets

U.S. PATENT DOCUMENTS

| | | | | |
|---|---|---|---|---|
| 3,828,567 | A | | 8/1974 | Lesczynski |
| 3,858,407 | A | | 1/1975 | Schumacher ..... 62/217 |
| 3,872,682 | A | | 3/1975 | Shook ..... 62/114 |
| 3,919,859 | A | * | 11/1975 | Ross ..... 62/503 |
| 4,009,596 | A | | 3/1977 | Morse |
| 4,019,679 | A | | 4/1977 | Vogt et al. ..... 237/2 B |
| 4,048,814 | A | | 9/1977 | Quack |
| 4,136,528 | A | | 1/1979 | Vogel et al. |
| 4,182,136 | A | | 1/1980 | Morse |
| 4,205,532 | A | | 6/1980 | Brenan ..... 62/115 |
| 4,439,996 | A | | 4/1984 | Frohbieter ..... 62/174 |
| 4,631,926 | A | | 12/1986 | Goldshtein et al. ..... 62/115 |
| 4,679,403 | A | | 7/1987 | Yoshida et al. ..... 62/114 |
| 4,702,086 | A | | 10/1987 | Nunn, Sr. et al. ..... 62/113 |
| 4,811,568 | A | | 3/1989 | Horan et al. |
| 5,042,262 | A | | 8/1991 | Gyger et al. ..... 62/64 |
| 5,062,274 | A | | 11/1991 | Shaw |
| 5,142,884 | A | | 9/1992 | Scaringe et al. |
| 5,167,128 | A | | 12/1992 | Bottum |
| 5,174,123 | A | | 12/1992 | Erickson |
| 5,245,836 | A | | 9/1993 | Lorentzen et al. |
| 5,394,709 | A | | 3/1995 | Lorentzen |
| 5,431,026 | A | | 7/1995 | Jaster |
| 5,497,631 | A | | 3/1996 | Lorentzen et al. |
| 5,611,547 | A | | 3/1997 | Baugh et al. ..... 277/121 |
| 5,655,378 | A | | 8/1997 | Pettersen |
| 5,685,160 | A | | 11/1997 | Abersfelder et al. ..... 62/114 |
| 5,692,389 | A | | 12/1997 | Lord et al. |
| 5,806,324 | A | | 9/1998 | Shaw |
| 5,829,262 | A | | 11/1998 | Urata et al. |
| 6,042,342 | A | | 3/2000 | Orian ..... 417/207 |
| 6,044,655 | A | | 4/2000 | Ozaki et al. ..... 62/205 |
| 6,073,454 | A | | 6/2000 | Spauschus et al. ..... 62/114 |
| 6,085,544 | A | | 7/2000 | Sonnekalb et al. ..... 62/498 |
| 6,105,386 | A | | 8/2000 | Kuroda et al. ..... 62/513 |
| 6,112,532 | A | | 9/2000 | Bakken |
| 6,112,547 | A | | 9/2000 | Spauschus et al. ..... 62/476 |
| 6,182,456 | B1 | | 2/2001 | Yamaguchi et al. |
| 6,185,955 | B1 | | 2/2001 | Yamamoto ..... 62/470 |
| 6,250,099 | B1 | | 6/2001 | Furuya et al. |
| 6,298,674 | B1 | | 10/2001 | Finkenberger et al. |
| 6,343,486 | B1 | | 2/2002 | Mizukami |
| 6,349,564 | B1 | | 2/2002 | Lingelbach et al. |
| 6,385,980 | B1 | | 5/2002 | Sienel |
| 6,385,981 | B1 | | 5/2002 | Vaisman ..... 62/196.3 |
| 6,418,735 | B1 | | 7/2002 | Sienel |
| 6,460,358 | B1 | | 10/2002 | Hebert |
| 2002/0050143 | A1 | | 5/2002 | Watanabe et al. |

FOREIGN PATENT DOCUMENTS

| | | |
|---|---|---|
| DE | 1021868 | 10/1958 |
| DE | 2401120 | 7/1975 |
| DE | 2604043 | 8/1976 |
| DE | 2660122 | 5/1978 |
| EP | 174027 | 3/1986 |
| EP | 0 604 417 B1 | 4/1996 |
| EP | 0 617 782 B1 | 5/1997 |
| EP | 0 424 474 B2 | 11/1997 |
| EP | 0 672 233 B1 | 11/1997 |
| EP | 1 043 550 | 10/2000 |
| GB | 1042975 | 9/1966 |
| JP | 11-63694 | 3/1999 |
| JP | 2000-46420 | 2/2000 |
| JP | 2001-221517 | 8/2001 |
| NO | 146882 | 9/1982 |
| RU | 1521998 | 11/1989 |
| SE | 463533 | 10/1988 |
| WO | 90/07683 | 7/1990 |

OTHER PUBLICATIONS

U.S. Appl. No. 10/166,646, entitled "Discharge Valve for Compressor" (TEC1194).

U.S. Appl. No. 10/812,213, entitled "Method and Apparatus for Reducing Inrush Current in a Multi-Stage Compressor" (TEC1288).

U.S. Appl. No. 10/902,635, entitled "Method and Apparatus for Determining Supercritical Pressure in a Heat Exchanger" (TEC1304).

U.S. Appl. No. 10/653,502 entitled "Apparatus for the Storage and Controlled Delivery of Fluids" (TEC1306).

U.S. Appl. No. 10/744,609, entitled "Transcritical Vapor Compression System and Method of Operating Including Refrigerant Storage Tank and Non-Variable Expansion Device" (TEC1307).

U.S. Appl. No. 10/755,947, entitled Method and Apparatus for Control of Carbon Dioxide Gas Cooler Pressure by Use of a Capillary Tube (TEC1308).

U.S. Appl. No. 10/796,711, entitled "Compact Rotary Compressor with Carbon Dioxide as Working Fluid" (TEC1363).

Refrigeration Engineering by H.J. MacIntire pp. 60-61, 1937.

Patent Abstracts of Japan, vol. 13, No. 489, M888, abstract of JP 01-193561, publ. Aug. 3, 1989.

"Cooling Machinery and Apparatuses", Gntimash, Moscow 1946, p. 4., Figs. 28-29.

"Principles of Refrigeration", by W.B. Gosney; Cambridge University Press, 1982.

Kalteprozesse Dargestallt Mit Hilfe Der Entropietofel, by Dipl•Ing. Prof. P. Ostertag, Berlin, Verlag Von Julius Springer, 1933 (w/translation).

* cited by examiner

MULTI-STAGE VAPOR COMPRESSION SYSTEM WITH INTERMEDIATE PRESSURE VESSEL

BACKGROUND OF THE INVENTION

1. Field of the Invention

The present invention relates to vapor compression systems and, more particularly, to a transcritical multi-stage vapor compression system having an intermediate pressure vessel or receiver.

2. Description of the Related Art

Vapor compression systems are used in a variety of applications including heat pump, air conditioning, and refrigeration systems. Such systems typically employ refrigerants, or working fluids, that remain below their critical pressure throughout the entire vapor compression cycle. Some vapor compression systems, however, such as those employing carbon dioxide as the working fluid, typically operate as transcritical systems wherein the working fluid is compressed to a pressure exceeding its critical pressure and wherein the suction pressure of the working fluid is less than the critical pressure of the working fluid. The basic structure of such a system includes a compressor for compressing the working fluid to a pressure that exceeds its critical pressure, followed by removal of heat from the working fluid in a first heat exchanger, e.g., a gas cooler. The pressure of the working fluid discharged from the gas cooler is reduced in an expansion device and then converted to a vapor in a second heat exchanger, e.g., an evaporator, before being returned to the compressor.

FIG. 1 illustrates a typical transcritical vapor compression system 10. In the illustrated example, a two stage compressor is employed having a first compression mechanism 12 and a second compression mechanism 14. The first compression mechanism compresses the working fluid from a suction pressure to an intermediate pressure. An intercooler 16 is positioned between the first and second compression mechanisms and cools the intermediate pressure working fluid. The second compression mechanism then compresses the working fluid from the intermediate pressure to a discharge pressure that exceeds the critical pressure of the working fluid. The working fluid is then cooled in a gas cooler 18. In the illustrated example, a suction line heat exchanger 20 further cools the high pressure working fluid before the pressure of the working fluid is reduced by expansion device 22. The working fluid then enters evaporator 24 where it is boiled and cools a secondary medium, such as air, that may be used, for example, to cool a refrigerated cabinet. The working fluid discharged from the evaporator 24 passes through the suction line heat exchanger 20 where it absorbs thermal energy from the high pressure working fluid before entering the first compression mechanism 12 to repeat the cycle.

The capacity and efficiency of such a transcritical system can be regulated by regulating the pressure of the high pressure portion, e.g., the pressure in gas cooler 18, of the system. The pressure of the high side gas cooler may, in turn, be regulated by regulating the mass of working fluid contained therein which is dependent upon the total charge of working fluid actively circulating through the system.

SUMMARY OF THE INVENTION

The present invention provides a vapor compression system that includes a multi-stage compressor assembly having first and second compression mechanisms wherein the first compression mechanism compresses the working fluid from a suction pressure to an intermediate pressure and the second compression mechanism compresses the working fluid from the intermediate pressure to a discharge pressure. The use of two stage compressors is advantageous when compressing a refrigerant, such as carbon dioxide, that must be compressed to a relatively high pressure and requires a relatively large pressure differential between the suction pressure and discharge pressure to function effectively as a refrigerant. An intermediate pressure vessel is in fluid communication with the system between the two compression mechanisms and stores a variable quantity of liquid phase working fluid. The system may be a transcritical system wherein the discharge pressure is above the critical pressure of the working fluid and the suction pressure is below the critical pressure of the working fluid as is typical when using carbon dioxide as a refrigerant. By controlling the quantity of liquid phase working fluid in the intermediate pressure vessel, the charge of working fluid present in the high pressure side of the system, including in the gas cooler, can be regulated and, thus, the efficiency and capacity of the system may also be regulated by controlling the quantity of liquid phase working fluid present in the intermediate pressure vessel.

The invention comprises, in one form thereof, a vapor compression system having a working fluid and including a first compression mechanism wherein the first compression mechanism compresses the working fluid from a first low pressure to a second intermediate pressure and a second compression mechanism wherein the second compression mechanism is in fluid communication with the first compression mechanism and compresses the working fluid from the second intermediate pressure to a third discharge pressure. A fluid circuit circulates the working fluid from the second compression mechanism to the first compression mechanism and includes, in serial order, a first heat exchanger, an expansion device and a second heat exchanger wherein the first heat exchanger is positioned in a high pressure side of the circuit between the second compression mechanism and the expansion device and the second heat exchanger is positioned in a low pressure side of the circuit between the expansion device and the first compression mechanism. Also included is an intermediate pressure vessel in fluid communication with the system between the first and second compression mechanisms. Intermediate pressure working fluid is communicated to and from the vessel and the vessel contains a variable quantity of liquid phase working fluid.

A single fluid conduit may be used to communicate working fluid between the vessel and the system wherein the single fluid conduit communicates both inflows and outflows of the working fluid between the vessel and the system between the first and second compression mechanisms. The fluid conduit providing communication of working fluid between the vessel and the system between the first and second compression mechanisms may also define an unregulated fluid passage, i.e., a passageway that does not include a valve for variably regulating the flow of working fluid therethrough during operation of the system.

At least one fluid conduit may also provide fluid communication between the vessel and the fluid circuit at a location between the second compression mechanism and the first compression mechanism and wherein at least one valve controls fluid flow through the at least one fluid conduit. An intermediate pressure heat exchanger, or intercooler, may also be positioned between the first and second compression mechanisms for cooling the intermediate pressure working fluid wherein the intermediate pressure vessel is in communication with the system between the intercooler and the second compression mechanism.

The quantity of liquid phase working fluid contained within the vessel varies as a function of the temperature of the contents of the vessel and a means for regulating this temperature of the vessel may also be provided. The temperature of the vessel may be regulated by the selective exchange of thermal energy between the vessel and one of: working fluid diverted from the fluid circuit, a secondary fluid, a heating element and an external temperature reservoir. The mass of the working fluid contained within the vessel may also be regulated by controlling the available storage volume within the vessel for containing working fluid. By regulating the mass of working fluid contained within the vessel, the mass of working fluid, and pressure thereof, in the first heat exchanger in the high side of the circuit can also be regulated thereby providing a means for regulating the capacity and efficiency of the system.

The present invention comprises, in another form thereof, a transcritical vapor compression system having a working fluid that includes a first compression mechanism wherein the first compression mechanism compresses the working fluid from a low pressure to an intermediate pressure and a second compression mechanism wherein the second compression mechanism is in fluid communication with the first compression mechanism and compresses the working fluid from the intermediate pressure to a discharge pressure wherein the discharge pressure is above the critical pressure of the working fluid. A fluid circuit circulates the working fluid from the second compression mechanism to the first compression mechanism and includes, in serial order, a first heat exchanger, an expansion device and a second heat exchanger wherein the first heat exchanger is positioned in a high pressure side of the circuit between the second compression mechanism and the expansion device and the second heat exchanger is positioned in a low pressure side of the circuit between the expansion device and the first compression mechanism. Also included is an intermediate pressure vessel that is in fluid communication with the system between the first and second compression mechanisms. Intermediate pressure working fluid is communicated to and from the vessel and the vessel contains a variable quantity of liquid phase working fluid wherein the quantity of liquid phase working fluid varies as a function of the temperature of the vessel.

The present invention comprises, in yet another form thereof, a method of regulating a transcritical vapor compression system having a working fluid. The method includes compressing the working fluid from a low pressure to an intermediate pressure in a first compression mechanism and compressing the working fluid from the intermediate pressure to a discharge pressure in a second compression mechanism wherein the discharge pressure is greater than the critical pressure of the working fluid. The method also includes circulating working fluid discharged from the second compression mechanism through a fluid circuit having, in serial order, a first heat exchanger, an expansion device and a second heat exchanger and then returning the fluid to the first compression mechanism wherein the first heat exchanger is positioned in a high pressure side of the circuit between the second compression mechanism and the expansion device and the second heat exchanger is positioned in a low side of the circuit between the expansion device and the first compression mechanism. The method further includes providing fluid communication of the working fluid between an intermediate pressure vessel and the system at a location between the first and second compression mechanisms. Intermediate pressure working fluid is communicated to and from the vessel and the vessel contains a variable quantity of liquid phase working fluid, the quantity of liquid phase working fluid varying as a function of the temperature of the vessel. The pressure in the first heat exchanger is regulated by controlling the temperature of the vessel.

Controlling the temperature of the vessel may involve selectively exchanging thermal energy between the vessel and one of working fluid diverted from the fluid circuit, a secondary fluid, a heating element and an external temperature reservoir. Providing fluid communication of the working fluid between the vessel and the system may include providing a single fluid conduit between the vessel and the system wherein the single fluid conduit communicates both inflows and outflows of the working fluid between the vessel and the system between the first and second compression mechanisms.

The present invention comprises, in another form thereof, a method of regulating a transcritical vapor compression system having a working fluid wherein the method includes compressing the working fluid from a low pressure to an intermediate pressure in a first compression mechanism and compressing the working fluid from the intermediate pressure to a discharge pressure in a second compression mechanism wherein the discharge pressure is greater than the critical pressure of the working fluid. The working fluid discharged from the second compression mechanism is circulated through a fluid circuit having, in serial order, a first heat exchanger, an expansion device and a second heat exchanger. The working fluid is then returned to the first compression mechanism. The first heat exchanger is positioned in a high pressure side of the circuit between the second compression mechanism and the expansion device and the second heat exchanger is positioned in a low side of the circuit between the expansion device and the first compression mechanism. The method also includes providing fluid communication of the working fluid between an intermediate pressure vessel and the system at a location between the first and second compression mechanisms. Intermediate pressure working fluid is communicated to and from the vessel and the vessel contains a variable quantity of liquid phase working fluid. All communication of working fluid to and from the vessel is communicated from and to the system between the first and second compression mechanisms. The pressure in the first heat exchanger is regulated by controlling the quantity of liquid phase working fluid within the vessel.

An advantage of the present invention is that by providing an intermediate pressure vessel located between two compression mechanisms of a multi-stage compressor, the vessel may be used to store a variable quantity of liquid phase working fluid wherein changing the stored quantity changes the capacity and efficiency of the system.

Another advantage is that by regulating the stored quantity of liquid phase working fluid in the intermediate pressure vessel, such as by regulating the temperature or available volume of the vessel, the capacity and efficiency of the system may be regulated.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
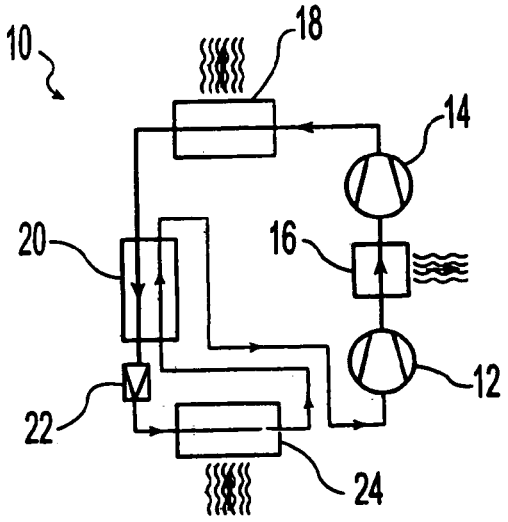
Fig. 1 Prior Art
FIG. 1 is a schematic representation of a prior art vapor compression system.

Corresponding reference characters indicate corresponding parts throughout the several views. Although the exemplification set out herein illustrates an embodiment of the invention, the embodiment disclosed below is not intended to be exhaustive or to be construed as limiting the scope of the invention to the precise form disclosed.

DESCRIPTION OF THE PRESENT INVENTION

Figure 2:
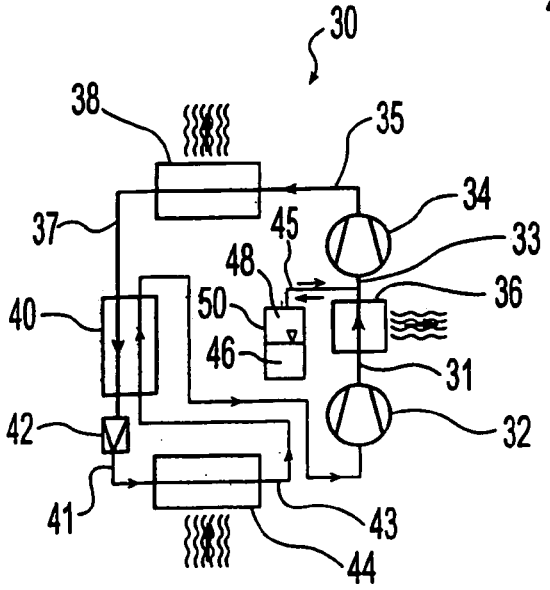
FIG. 2 is a schematic view of a vapor compression system in accordance with the present invention.

A vapor compression system 30 in accordance with the present invention is schematically illustrated in FIG. 2. System 30 has a two stage compressor assembly that includes a first compression mechanism 32 and a second compression mechanism 34. The compression mechanisms 32, 34 may be any suitable type of compression mechanism such as a rotary, reciprocating or scroll-type compressor mechanism. An intercooler 36, i.e., a heat exchanger, is positioned in the system between first compression mechanism 32 and second compression mechanism 34 to cool the intermediate pressure working fluid as discussed in greater detail below. A conventional gas cooler 38 cools the working fluid discharged from second compression mechanism 34 and suction line heat exchanger 40 further cools the working fluid before the pressure of the working fluid is reduced by expansion device 42.

After the pressure of the working fluid is reduced by expansion device 42, the working fluid enters evaporator 44 where it is absorbs thermal energy as it is converted from a liquid phase to a gas phase. The suction line heat exchanger 40, expansion device 42 and evaporator 44 may all be of a conventional construction well known in the art. After being discharged from evaporator 44, the low or suction pressure working fluid passes through heat exchanger 40 to cool the high pressure working fluid before it is returned to first compression mechanism 32 and the cycle is repeated. Also included in system 30 is an intermediate pressure vessel 50 that is in fluid communication with system 30 between first compression mechanism 32 and second compression mechanism 34 and stores both liquid phase working fluid 46 and gaseous phase working fluid 48 as discussed in greater detail below.

Figure 3:
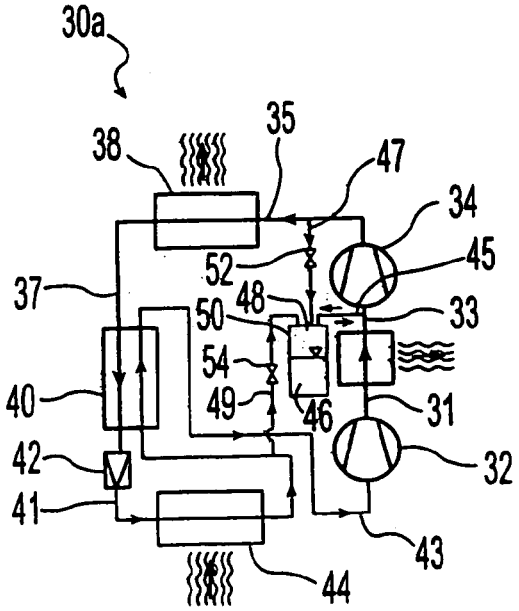
FIG. 3 is a schematic view of another vapor compression system in accordance with present invention.

As shown in FIGS. 2 and 3, schematically represented fluid lines or conduits 31, 33, 35, 37, 41, and 43 provide fluid communication between first compression mechanism 32, intermediate pressure cooler 36, second compression mechanism 34, gas cooler 38, expansion device 42, evaporator 44 and first compression mechanism 32 in serial order. Heat exchanger 40 exchanges thermal energy between different points of the fluid circuit that are located in that portion of the circuit schematically represented by conduits 37 and 43 cooling the high pressure working fluid conveyed within line 37. The fluid circuit extending from second compression mechanism 34 to first compression mechanism 32 has a high pressure side and a low pressure side. The high pressure side extends from second compression mechanism 34 to expansion device 42 and includes conduit 35, gas cooler 38 and conduit 37. The low pressure side extends from expansion device 42 to first compression mechanism 32 and includes conduit 41, evaporator 44 and conduit 43. That portion of the system between first compression mechanism 32 and second compression mechanism 34 is at an intermediate pressure and includes conduits 31, 33, intermediate pressure cooler 36 and intermediate pressure vessel 50.

In operation, the illustrated embodiment of system 30 is a transcritical system utilizing carbon dioxide as the working fluid wherein the working fluid is compressed above its critical pressure and returns to a subcritical pressure with each cycle through the vapor compression system. Capacity control for such a transcritical system differs from a conventional vapor compression system wherein the working fluid remains at subcritical pressures throughout the vapor compression cycle. In such subcritical systems, capacity control is often achieved using thermal expansion valves to vary the mass flow through the system and the pressure within the condenser is primarily determined by the ambient temperature. In a transcritical system, the capacity of the system may be regulated by controlling the vapor/liquid ratio of the working fluid exiting the expansion device which is, in turn, a function of the pressure within the high pressure gas cooler. The pressure within the gas cooler may be regulated by controlling the total charge of working fluid circulating in the system wherein an increase in the total charge results in an increase in the pressure in the gas cooler, e.g., cooler 38, a reduction in the vapor/liquid ratio exiting expansion device 42 and an increase in the capacity of the system and a decrease in the total charge results in an increase in the vapor/liquid ratio exiting expansion device 42 and a decrease in the capacity of the system. The efficiency of the system will also vary with changes in the pressure in gas cooler 38, however, gas cooler pressures that correspond to the optimal efficiency of system 30 and the maximum capacity of system 30 will generally differ.

By regulating the mass of the working fluid contained within intermediate pressure vessel 50, the total charge of the working fluid that is actively circulating within system 30 can be controlled and, thus, the capacity and efficiency of system 30 can be controlled. The mass of working fluid contained within vessel 50 may be controlled by various means including the regulation of the temperature of vessel 50 or the regulation of the available storage volume within vessel 50 for containing working fluid.

Figure 8:
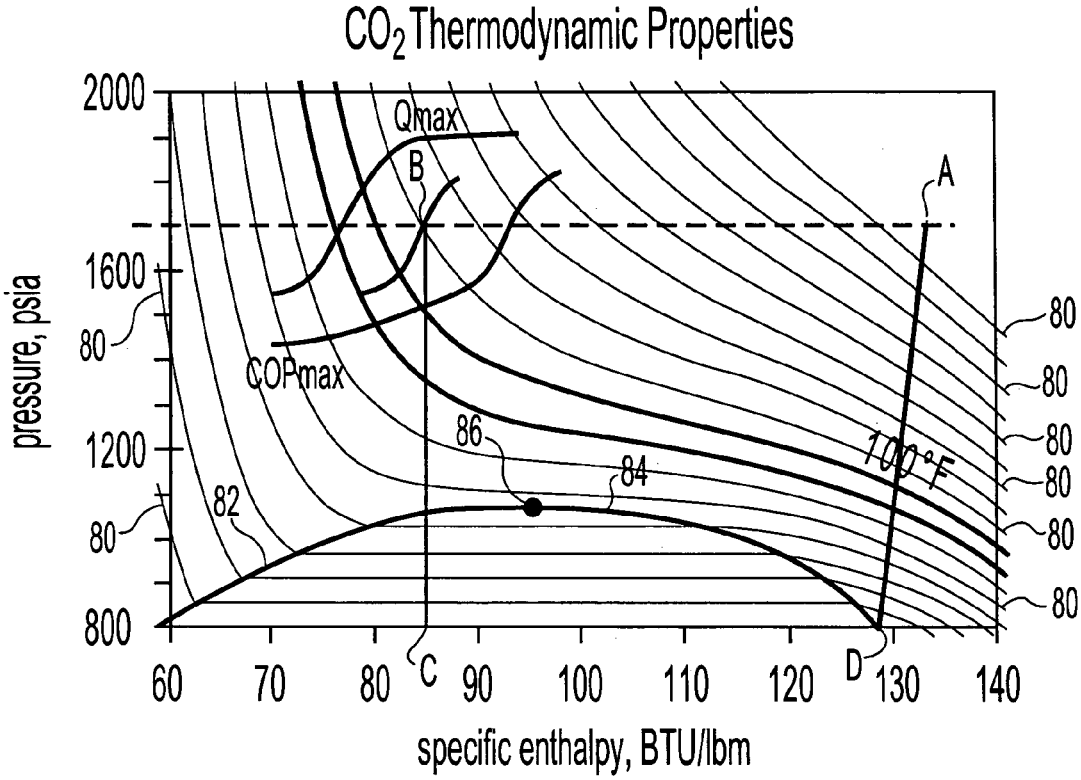
FIG. 8 is graph illustrating the thermodynamic properties of carbon dioxide.

The thermodynamic properties of carbon dioxide are shown in the graph of FIG. 8. Lines 80 are isotherms and represent the properties of carbon dioxide at a constant temperature. Lines 82 and 84 represent the boundary between two phase conditions and single phase conditions and meet at point 86, a maximum pressure point of the common line defined by lines 82, 84. Line 82 represents the liquid saturation curve while line 84 represents the vapor saturation curve.

The area below lines 82, 84 represents the two phase subcritical region where boiling of carbon dioxide takes place at a constant pressure and temperature. The area above point 86 represents the supercritical region where cooling or heating of the carbon dioxide does not change the phase (liquid/vapor) of the carbon dioxide. The phase of a carbon dioxide in the supercritical region is commonly referred to as "gas" instead of liquid or vapor.

The lines $Q_{max}$ and $COP_{max}$ represent gas cooler discharge values for maximizing the capacity and efficiency respectively of the system. The central line positioned therebetween represents values that provide relatively high, although not maximum, capacity and efficiency. Moreover, when the system fails to operate according to design parameters defined by this central line, the system will suffer a decrease in either the capacity or efficiency and an increase in the other value unless such variances are of such magnitude that they represent a point no longer located between the $Q_{max}$ and $COP_{max}$ lines.

Point A represents the working fluid properties as discharged from second compression mechanism 34 (and at the inlet of gas cooler 38). Point B represents the working fluid properties at the inlet to expansion device 42 (if systems 30, 30*a* did not include heat exchanger 40, point B would represent the outlet of gas cooler 38). Point C represents the working fluid properties at the inlet of evaporator 44 (or outlet of expansion device 42). Point D represents the working fluid at the inlet to first compression mechanism 32 (if systems 30, 30*a* did not include heat exchanger 40, point C would represent the outlet of evaporator 44). Movement from point D to point A represents the compression of the working fluid. (Line D–A is a simplified representation of the net result of compressing the working fluid which does not graphically depict the individual results of each compressor stage and intercooler 36.) As can be seen, compressing the working fluid both raises its pressure and its temperature. Moving from point A to point B represents the cooling of the high pressure working fluid at a constant pressure in gas cooler 38 (and heat exchanger 40). Movement from point B to point C represents the action of expansion device 42 which lowers the pressure of the working fluid to a subcritical pressure. Movement from point C to point D represents the action of evaporator 44 (and heat exchanger 40). Since the working fluid is at a subcritical pressure in evaporator 44, thermal energy is transferred to the working fluid to change it from a liquid phase to a gas phase at a constant temperature and pressure. The capacity of the system (when used as a cooling system) is determined by the mass flow rate through the system and the location of point C and the length of line C–D which in turn is determined by the specific enthalpy of the working fluid at the evaporator inlet. Thus, reducing the specific enthalpy at the evaporator inlet without substantially changing the mass flow rate and without altering the other operating parameters of system 30, will result in a capacity increase in the system. This can be done by decreasing the mass of working fluid contained in intermediate pressure vessel 50, thereby increasing both the mass and pressure of working fluid contained in gas cooler 38. If the working fluid in gas cooler 38 is still cooled to the same gas cooler discharge temperature, this increase in gas cooler pressure will shift line A–B upwards and move point B to the left (as depicted in FIG. 8) along the isotherm representing the outlet temperature of the gas cooler. This, in turn, will shift point C to the left and increase the capacity of the system. Similarly, by increasing the mass of working fluid contained in intermediate pressure vessel 50, the mass and pressure of working fluid contained within gas cooler 38 can be reduced to thereby reduce the capacity of the system.

During compression of the working fluid, vapor at a relatively low pressure and temperature enters first compression mechanism 32 and is discharged therefrom at a higher pressure and temperature. Working fluid at this intermediate pressure is then passed through intercooler 36 to reduce the temperature of the intermediate pressure working fluid before it enters second compression mechanism and is compressed to a supercritical discharge pressure and relatively high temperature. When vessel 50 relies upon temperature regulation to control the mass of working fluid contained therein, vessel 50 is advantageously positioned to receive working fluid at an intermediate pressure between the first and second compression mechanisms 32, 34 at a point after the intermediate pressure working fluid has been cooled in intercooler 36. The mass of working fluid contained within vessel 50 is dependent upon the relative amounts of the liquid phase fraction 46 and the gaseous phase fraction 48 of the working fluid that is contained within vessel 50 and the available storage volume within vessel 50. By increasing the quantity of the liquid phase working fluid 46 in vessel 50, the mass of the working fluid contained therein is also increased. Similarly, the mass of the working fluid contained in vessel 50 may be decreased by decreasing the quantity of liquid phase working fluid 46 contained therein. By reducing the temperature of the working fluid within vessel 50 below the saturation temperature of the working fluid at the intermediate pressure, the quantity of liquid phase working fluid 46 contained within vessel 50 may be increased. Similarly, by raising the temperature of vessel 50, and the working fluid contained therein, some of the liquid phase working fluid 46 can be evaporated and the quantity of the liquid phase working fluid 46 contained therein may be reduced. By positioning vessel 50 to receive intermediate pressure working fluid after the working fluid has been cooled in intercooler 36, the incoming working fluid will be nearer its saturation temperature than if vessel 50 were positioned between first compression mechanism 32 and intercooler 36 and the transfer of thermal energy at vessel 50 during operation of system 30 may be relatively smaller. Various embodiments of vessel 50 are discussed in greater detail below.

In the embodiment of FIG. 2, the illustrated intermediate pressure storage vessel 50 is shown having a single fluid line 45 providing fluid communication between the vessel and the system at a location between first and second compression mechanisms 32, 34. In this embodiment, fluid line 45 provides for both the inflow and outflow of working fluid to and from vessel 50 and all working fluid communicated to and from vessel 50 is communicated by fluid line 45. In the system 30*a* illustrated in FIG. 3, fluid line 45 provides for both the inflow and outflow of working fluid to and from vessel 50, however, fluid lines 47, 49 may also communicate working fluid between vessel 50 and the fluid circuit. In the illustrated embodiments, fluid line 45 provides an unregulated fluid passage between vessel 50 and fluid line 33 leading to second compression mechanism 34, i.e., there is no valve present in fluid line 45 that is used to regulate the flow of fluid thererthrough during operation of the vapor compression system. Alternative embodiments of the present invention, however, may utilize a fluid line 45 between the vessel and the system wherein the interconnecting fluid line includes a valve for regulating the flow of fluid therethrough during operation of the system.

Second embodiment 30*a* of a vapor compression system in accordance with the present invention is schematically represented in FIG. 3. System 30*a* is similar to system 30 shown in FIG. 2 but also includes a high pressure fluid line 47 having a valve 52 extending from high pressure fluid line 35 to intermediate pressure vessel 50 and a low pressure fluid line 49 having valve 54 extending from low pressure fluid line 43 to intermediate pressure vessel 50. In the embodiment of FIG. 3, when it is desired to raise the temperature of the contents of vessel 50 to decrease the quantity of liquid phase working fluid 46 contained therein, valve 52 may be opened to allow warm, high pressure working fluid into vessel 50 from fluid line 35. When it is desired to increase the quantity of liquid phase working fluid contained within vessel 50, valve 54 may be opened to allow cool, low pressure working fluid into vessel 50 from line 43. It may also be desirable to include another valve (not shown) in line 45 in system 30*a* to provide greater control of the flow of working fluid from vessel 50 to second compression mechanism 34. An electronic controller may be used to selectively actuate the valves regulating flow into and out of vessel 50 based upon temperature and pressure sensor readings obtained at appropriate points in system 30*a* to thereby control the operation of system 30*a*.

Figure 4:
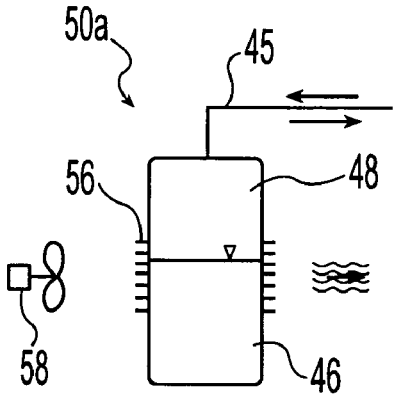
FIG. 4 is a schematic view of intermediate pressure vessel.
Figure 5:
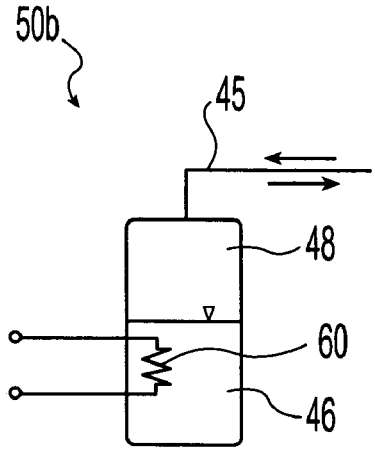
FIG. 5 is a schematic view of another intermediate pressure vessel.

Several exemplary embodiments of the intermediate pressure vessel 50 are represented in FIGS. 4–7. Embodiment 50*a* is schematically represented in FIG. 4 and utilizes an air blower to cool vessel 50*a*. Illustrated vessel 50*a* includes heat radiating fins 56 to facilitate the transfer of thermal energy and a fan 58. The operation of fan 58 is controlled to regulate the temperature of vessel 50*a* and thereby regulate the quantity of liquid phase fluid 46 contained therein.

Embodiment 50*b* regulates the temperature of vessel 50*b* by providing a means of imparting heat to the contents of vessel 50*b*. In embodiment 50*b* schematically represented in FIG. 5 an electrical heating element 60 is used to selectively impart heat to the contents of vessel 50*b* and thereby reduce the quantity of liquid phase working fluid 46 contained within vessel 50*b*. In alternative embodiments, heating element 60 could be used in combination with a means for reducing the temperature of the intermediate pressure vessel.

Figure 6:
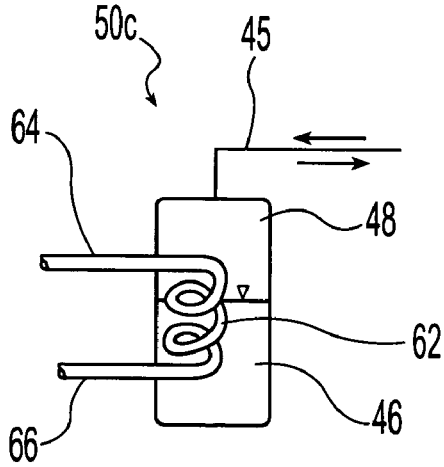
FIG. 6 is a schematic view of another intermediate pressure vessel.

Embodiment 50*c* is schematically represented in FIG. 6 and includes a heat exchange element 62, an input line 64 and a discharge line 66. In this embodiment a fluid is circulated from input line 64 through heat exchange element 62 and then discharge line 66. Thermal energy is exchanged between the fluid circulated within heat exchange element 62 and the contents of vessel 50*c* to thereby control the temperature of vessel 50*c*. Heat exchange element 62 is illustrated as being positioned in the interior of vessel 50*c*. In alternative embodiments, a similar heat exchange element could be positioned on the exterior of the intermediate pressure vessel to exchange thermal energy therewith. The heat exchange medium that is circulated through heat exchange element 62 and lines 64, 66 may be used to either heat or cool the contents of vessel 50*c*. For example, input line 64 could be in fluid communication with high temperature, high pressure line 35 and convey working fluid therethrough that is at a temperature greater than the contents of vessel 50*c* to thereby heat vessel 50*c* and reduce the quantity of liquid phase working fluid 46 contained within vessel 50*c*. Discharge line 66 may discharge the high pressure working fluid to line 31 between first compression mechanism 32 and intercooler 36 or other suitable location in system 30. Alternatively, input line 64 could be in fluid communication with suction line 43 (advantageously before line 43 enters heat exchanger 40) whereby heating element 62 would convey working fluid therethrough that is at a temperature that is less than that of vessel 50*c* and thereby cool vessel 50*c* and increase the quantity of liquid phase working fluid 46 contained therein. Discharge line 66 may discharge the low pressure working fluid to line 43 between heat exchanger 40 and first compression mechanism 32 or other suitable location in system 30. A valve (not shown) is placed in input line 64 and selectively actuated to control the flow of fluid through heat exchange element 62 and thereby control the temperature of vessel 50*c* and quantity of liquid phase working fluid 46 contained therein. Other embodiments may exchange thermal energy between the fluid conveyed within heat exchange element 62 and an alternative external temperature reservoir, i.e., either a heat sink or a heat source.

Figure 7:
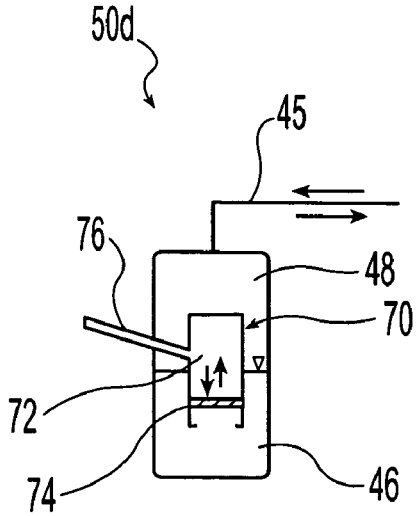
FIG. 7 is a schematic view of another intermediate pressure vessel.

Embodiment 50*d* is schematically represented in FIG. 7 and includes a variable volume element 70 that in the illustrated embodiment includes a chamber 72 and piston 74 and input 76. Piston 74 is selectively moveable to increase or decrease the volume of chamber 72 and thereby respectively decrease or increase the storage volume of vessel 50*d* available for the storage of working fluid therein. Unlike vessel embodiments 50*a*–50*c* which rely upon regulation of the temperature of the intermediate pressure vessel to control the quantity of liquid phase working fluid 46 contained within the vessel, vessel 50*d* regulates the volume of chamber 72 to control the available storage volume for liquid phase working fluid 46 and thereby regulate the quantity of liquid phase working fluid 46 contained within vessel 50*d*. Chamber 72 is filled with a gas, e.g., such as gaseous phase working fluid 48, and input 76 transfers thermal energy to the gas filling chamber 72. By heating the gas filling chamber 72, the gas filling chamber 72 may be expanded pushing piston 74 downward and reducing the available storage volume within vessel 50*d*. Alternatively, cooling the gas filling chamber 72 will contract the gas allowing piston 74 to move upward and thereby enlarging the available storage volume within vessel 50*d*. Thermal transfers with the gas filling chamber 72 may take place by communicating relatively warm or cool working fluid to chamber 72 through input 76 from another location in system 30. Input line 76 may extend into chamber 72 and have a closed end (not shown) whereby the heat exchange medium within line 76 remains within line 76 and does not enter chamber 72 such that it would contact piston 74 directly. Alternatively a heating element similar to element 60 or heat exchange element similar to element 62 could be positioned within chamber 72. Other embodiments of intermediate pressure vessels having a variable storage volume may utilize expandable/contractible chambers that are formed using flexible bladders. Various other embodiments of such vessels that may be used with the present invention are described in greater detail by Manole, et al. in a U.S. patent application entitled APPARATUS FOR THE STORAGE AND CONTROLLED DELIVERY OF FLUIDS filed on the same date as the present application which is hereby incorporated herein by reference.

An electronic controller (not shown) may be used to control the operation of the intermediate pressure vessel based upon temperature and pressure sensor readings obtained at appropriate locations in the system, e.g., temperature and pressure data obtained at the inlet and outlet of gas cooler 38 and evaporator 44 and in intermediate pressure vessel 50 and thereby determine the current capacity of the system and load being placed on the system. As described above intermediate pressure vessel 50 is controllable such that working fluid may be accumulated or released in or from the intermediate pressure vessel 50 to thereby increase or decrease the capacity of the system to correspond to the load placed on the system.

While this invention has been described as having an exemplary design, the present invention may be further modified within the spirit and scope of this disclosure. This application is therefore intended to cover any variations, uses, or adaptations of the invention using its general principles.

What is claimed is:

1. A vapor compression system having a working fluid and comprising:

a first compression mechanism, said first compression mechanism compressing the working fluid from a first low pressure to a second intermediate pressure;

a second compression mechanism, said second compression mechanism in fluid communication with said first compression mechanism and compressing the working fluid from the second intermediate pressure to a third discharge pressure;

a fluid circuit circulating the working fluid from said second compression mechanism to said first compression mechanism and including, in serial order, a first heat exchanger, an expansion device and a second heat exchanger wherein said first heat exchanger is positioned in a high pressure side of said circuit between said second compression mechanism and said expansion device and said second heat exchanger is positioned in a low pressure side of said circuit between said expansion device and said first compression mechanism; and an intermediate pressure vessel in fluid communication with said system between said first and second compression mechanisms wherein intermediate pressure working fluid is communicated to and from said vessel and said vessel contains a variable quantity of liquid phase working fluid, wherein a single fluid conduit communicates both inflows and outflows of the working fluid between said vessel and said system at a location between said first and second compression mechanisms.

2. The vapor compression system of claim 1 wherein a fluid conduit providing communication of working fluid between said vessel and said system between said first and second compression mechanisms defines an unregulated fluid passage.

3. The vapor compression system of claim 1 wherein the discharge pressure of the working fluid is greater than the critical pressure of the working fluid.

4. The vapor compression system of claim 1 further including at least one fluid conduit providing fluid communication between said vessel and said fluid circuit between said second compression mechanism and said first compression mechanism and at least one valve controlling fluid flow through said at least one fluid conduit.

5. The vapor compression system of claim 1 further comprising a third heat exchanger disposed in said system between said first and second compression mechanisms.

6. The vapor compression system of claim 1 wherein the quantity of liquid phase working fluid contained within said vessel varies as a function of the temperature of said vessel.

7. The vapor compression system of claim 1 wherein said intermediate pressure vessel has a selectively adjustable storage volume.

8. The vapor compression system of claim 1, further comprising at least one additional fluid conduit communicating working fluid between said vessel and at least one location in said system other than between said first and second compression mechanisms.

9. A vapor compression system having a working fluid and comprising:

a first compression mechanism, said first compression mechanism compressing the working fluid from a first low pressure to a second intermediate pressure;

a second compression mechanism, said second compression mechanism in fluid communication with said first compression mechanism and compressing the working fluid from the second intermediate pressure to a third discharge pressure;

a fluid circuit circulating the working fluid from said second compression mechanism to said first compression mechanism and including, in serial order, a first heat exchanger, an expansion device and a second heat exchanger wherein said first heat exchanger is positioned in a high pressure side of said circuit between said second compression mechanism and said expansion device and said second heat exchanger is positioned in a low pressure side of said circuit between said expansion device and said first compression mechanism; and an intermediate pressure vessel in fluid communication with said system between said first and second compression mechanisms wherein intermediate pressure working fluid is communicated to and from said vessel and said vessel contains a variable quantity of liquid phase working fluid, wherein all working fluid communicated to and from said vessel is communicated from and to said system between said first and second compression mechanisms.

10. A vapor compression system having a working fluid and comprising:

a first compression mechanism, said first compression mechanism compressing the working fluid from a first low pressure to a second intermediate pressure;

a second compression mechanism, said second compression mechanism in fluid communication with said first compression mechanism and compressing the working fluid from the second intermediate pressure to a third discharge pressure;

a fluid circuit circulating the working fluid from said second compression mechanism to said first compression mechanism and including, in serial order, a first heat exchanger, an expansion device and a second heat exchanger wherein said first heat exchanger is positioned in a high pressure side of said circuit between said second compression mechanism and said expansion device and said second heat exchanger is positioned in a low pressure side of said circuit between said expansion device and said first compression mechanism;

an intermediate pressure vessel in fluid communication with said system between said first and second compression mechanisms wherein intermediate pressure working fluid is communicated to and from said vessel and said vessel contains a variable quantity of liquid phase working fluid, wherein the quantity of liquid phase working fluid contained within said vessel varies as a function of the temperature of said vessel; and means for regulating the temperature of said vessel.

11. A vapor compression system having a working fluid and comprising:

a first compression mechanism, said first compression mechanism compressing the working fluid from a first low pressure to a second intermediate pressure;

a second compression mechanism, said second compression mechanism in fluid communication with said first compression mechanism and compressing the working fluid from the second intermediate pressure to a third discharge pressure;

a fluid circuit circulating the working fluid from said second compression mechanism to said first compression mechanism and including, in serial order, a first heat exchanger, an expansion device and a second heat exchanger wherein said first heat exchanger is positioned in a high pressure side of said circuit between said second compression mechanism and said expansion device and said second heat exchanger is positioned in a low pressure side of said circuit between said expansion device and said first compression mechanism; and an intermediate pressure vessel in fluid communication with said system between said first and second compression mechanisms wherein intermediate pressure working fluid is communicated to and from said vessel and said vessel contains a variable quantity of liquid phase working fluid, wherein the quantity of liquid phase working fluid contained within said vessel varies as a function of the temperature of said vessel, and wherein the temperature of said vessel is regulated by the selective exchange of thermal energy between said vessel and one of working fluid diverted from said fluid circuit, a secondary fluid, a heating element, and an external temperature reservoir.

12. A vapor compression system having a working fluid and comprising:

a first compression mechanism, said first compression mechanism compressing the working fluid from a first low pressure to a second intermediate pressure;

a second compression mechanism, said second compression mechanism in fluid communication with said first compression mechanism and compressing the working fluid from the second intermediate pressure to a third discharge pressure;

a fluid circuit circulating the working fluid from said second compression mechanism to said first compression mechanism and including, in serial order, a first heat exchanger, an expansion device and a second heat exchanger wherein said first heat exchanger is positioned in a high pressure side of said circuit between said second compression mechanism and said expansion device and said second heat exchanger is positioned in a low pressure side of said circuit between said expansion device and said first compression mechanism;

an intermediate pressure vessel in fluid communication with said system between said first and second compression mechanisms wherein intermediate pressure working fluid is communicated to and from said vessel and said vessel contains a variable quantity of liquid phase working fluid; and an intermediate pressure heat exchanger cooling intermediate pressure working fluid and positioned between said first compression mechanism and said intermediate pressure vessel.

13. A transcritical vapor compression system having a working fluid, said system comprising:

a first compression mechanism, said first compression mechanism compressing the working fluid from a low pressure to an intermediate pressure;

a second compression mechanism, said second compression mechanism in fluid communication with said first compression mechanism and compressing the working fluid from the intermediate pressure to a discharge pressure wherein the discharge pressure is above the critical pressure of the working fluid;

a fluid circuit circulating the working fluid from said second compression mechanism to said first compression mechanism and including, in serial order, a first heat exchanger, an expansion device and a second heat exchanger wherein the first heat exchanger is positioned in a high pressure side of said circuit between said second compression mechanism and said expansion device and said second heat exchanger is positioned in a low pressure side of said circuit between said expansion device and said first compression mechanism; and an intermediate pressure vessel in fluid communication with said system between said first and second compression mechanisms wherein intermediate pressure working fluid is communicated to an from said vessel and said vessel contains a variable quantity of liquid phase working fluid, said quantity of liquid phase working fluid varying as a function of the temperature of said vessel, wherein a single fluid conduit communicates working fluid between said vessel and said system, said single fluid conduit communicating both inflows and outflows of the working fluid between said vessel and said system between said first and second compression mechanisms.

14. A transcritical vapor compression system having a working fluid, said system comprising:

a first compression mechanism, said first compression mechanism compressing the working fluid from a low pressure to an intermediate pressure;

a second compression mechanism, said second compression mechanism in fluid communication with said first compression mechanism and compressing the working fluid from the intermediate pressure to a discharge pressure wherein the discharge pressure is above the critical pressure of the working fluid;

a fluid circuit circulating the working fluid from said second compression mechanism to said first compression mechanism and including, in serial order, a first heat exchanger, an expansion device and a second heat exchanger wherein the first heat exchanger is positioned in a high pressure side of said circuit between said second compression mechanism and said expansion device and said second heat exchanger is positioned in a low pressure side of said circuit between said expansion device and said first compression mechanism; and an intermediate pressure vessel in fluid communication with said system between said first and second compression mechanisms wherein intermediate pressure working fluid is communicated to an from said vessel and said vessel contains a variable quantity of liquid phase working fluid, said quantity of liquid phase working fluid varying as a function of the temperature of said vessel, wherein all working fluid communicated to and from said vessel is communicated from and to said system between said first and second compression mechanisms.

15. A transcritical vapor compression system having a working fluid, said system comprising:

a first compression mechanism, said first compression mechanism compressing the working fluid from a low pressure to an intermediate pressure;

a second compression mechanism, said second compression mechanism in fluid communication with said first compression mechanism and compressing the working fluid from the intermediate pressure to a discharge pressure wherein the discharge pressure is above the critical pressure of the working fluid;

a fluid circuit circulating the working fluid from said second compression mechanism to said first compression mechanism and including, in serial order, a first heat exchanger, an expansion device and a second heat exchanger wherein the first heat exchanger is positioned in a high pressure side of said circuit between said second compression mechanism and said expansion device and said second heat exchanger is positioned in a low pressure side of said circuit between said expansion device and said first compression mechanism;

an intermediate pressure vessel in fluid communication with said system between said first and second compression mechanisms wherein intermediate pressure working fluid is communicated to and from said vessel and said vessel contains a variable quantity of liquid phase working fluid, said quantity of liquid phase working fluid varying as a function of the temperature of said vessel; and temperature regulator in thermal communication with said vessel.

16. The vapor compression system of claim 15 wherein a fluid conduit providing communication of working fluid between said vessel and said system between said first and second compression mechanisms defines an unregulated fluid passage.

17. The vapor compression system of claim 15 further including at least one fluid conduit providing fluid communication between said vessel and said fluid circuit between said second compression mechanism and said first compression mechanism and at least one valve controlling fluid flow through said at least one fluid conduit.

18. The vapor compression system of claim 15 further comprising a third heat exchanger disposed in said system between said first and second compression mechanisms.

19. The vapor compression system of claim 15 wherein the temperature of said vessel is regulated by the selective exchange of thermal energy between said vessel and one of working fluid diverted from said fluid circuit, a secondary fluid, and an external heat source.

20. The vapor compression system of claim 15 further comprising an intermediate pressure heat exchanger cooling intermediate pressure working fluid and positioned between said first compression mechanism and said intermediate pressure vessel.

21. A method of regulating a transcritical vapor compression system having a working fluid, said method comprising:

compressing the working fluid from a low pressure to an intermediate pressure in a first compression mechanism;

compressing the working fluid from the intermediate pressure to a discharge pressure in a second compression mechanism, the discharge pressure being greater than the critical pressure of the working fluid;

circulating working fluid discharged from the second compression mechanism through a fluid circuit having, in serial order, a first heat exchanger, an expansion device and a second heat exchanger and then returning the fluid to the first compression mechanism wherein the first heat exchanger is positioned in a high pressure side of the circuit between the second compression mechanism and the expansion device and the second heat exchanger is positioned in a low side of the circuit between the expansion device and the first compression mechanism;

providing fluid communication of the working fluid between an intermediate pressure vessel and the system at a location between the first and second compression mechanisms wherein intermediate pressure working fluid is communicated to and from said vessel and said vessel contains a variable quantity of liquid phase working fluid, the quantity of liquid phase working fluid varying as a function of the temperature of the vessel; and regulating the pressure in the first heat exchanger by controlling the temperature of the vessel.

22. The method of claim 21 wherein controlling the temperature of the vessel comprises selectively exchanging thermal energy between the vessel and one of working fluid diverted from the fluid circuit, a secondary fluid, a heating element, and an external temperature reservoir.

23. The method of claim 21 wherein providing fluid communication of the working fluid between the vessel and the system includes providing a single fluid conduit between the vessel and the system, the single fluid conduit communicating both inflows and outflows of the working fluid between the vessel and the system between the first and second compression mechanisms.

24. The method of claim 21 wherein all working fluid communicated to and from the vessel is communicated from and to the system between the first and second compression mechanisms.

25. The method of claim 21 further comprising cooling the intermediate pressure working fluid between the first compression mechanism and the intermediate pressure vessel.

26. A method of regulating a transcritical vapor compression system having a working fluid, said method comprising:

compressing the working fluid from a low pressure to an intermediate pressure in a first compression mechanism;

compressing the working fluid from the intermediate pressure to a discharge pressure in a second compression mechanism, the discharge pressure being greater than the critical pressure of the working fluid;

circulating working fluid discharged from the second compression mechanism through a fluid circuit having, in serial order, a first heat exchanger, an expansion device and a second heat exchanger and then returning the fluid to the first compression mechanism wherein the first heat exchanger is positioned in a high pressure side of the circuit between the second compression mechanism and the expansion device and the second heat exchanger is positioned in a low side of the circuit between the expansion device and the first compression mechanism;

providing fluid communication of the working fluid between an intermediate pressure vessel and the system at a location between the first and second compression mechanisms, intermediate pressure working fluid is communicated to and from said vessel and said vessel contains a variable quantity of liquid phase working fluid, all communication of working fluid to and from the vessel being communicated from and to the system between the first and second compression mechanisms; and regulating the pressure in the first heat exchanger by controlling the quantity of liquid phase working fluid within the vessel.

27. The method of claim 26 wherein controlling the quantity of liquid phase working fluid within the vessel comprises controlling the temperature of the vessel.

28. The method of claim 26 wherein controlling the quantity of liquid phase working fluid within the vessel comprises controlling the storage volume of the vessel.

29. The method of claim 26 wherein providing fluid communication of the working fluid between the vessel and the system includes providing a single fluid conduit between the vessel and the system, the single fluid conduit communicating both inflows and outflows of the working fluid between the vessel and the system between the first and second compression mechanisms.

30. The method of claim 26 further comprising cooling the intermediate pressure working fluid between the first compression mechanism and the intermediate pressure vessel.

31. A vapor compression system having a working fluid and comprising:

a first compression mechanism, said first compression mechanism compressing the working fluid from a first low pressure to a second intermediate pressure;

a second compression mechanism, said second compression mechanism in fluid communication with said first compression mechanism and compressing the working fluid from the second intermediate pressure to a third discharge pressure;

a fluid circuit circulating the working fluid from said second compression mechanism to said first compression mechanism and including, in serial order, a first heat exchanger, an expansion device and a second heat exchanger wherein said first heat exchanger is positioned in a high pressure side of said circuit between said second compression mechanism and said expansion device and said second heat exchanger is positioned in a low pressure side of said circuit between said expansion device and said first compression mechanism; and a working fluid vessel in fluid communication with said system between said second compression mechanism and said first heat exchanger wherein working fluid is communicated to and from said vessel and said vessel contains a variable quantity of liquid phase working fluid varying as a function of the temperature of the vessel; and a temperature regulator in thermal communication with said vessel.

* * * * *

UNITED STATES PATENT AND TRADEMARK OFFICE

CERTIFICATE OF CORRECTION

PATENT NO. : 6,923,011 B2
DATED : August 2, 2005
INVENTOR(S) : Dan M. Manole

It is certified that error appears in the above-identified patent and that said Letters Patent is hereby corrected as shown below:

Column 14,
Lines 17 and 52, delete “an” and insert -- and --.

Signed and Sealed this

Twenty-fifth Day of October, 2005

JON W. DUDAS
*Director of the United States Patent and Trademark Office*